US005478454A

United States Patent [19]

Inoue

[11] Patent Number: 5,478,454

[45] Date of Patent: Dec. 26, 1995

[54] ELECTRODEPOSITION PAINTING DEVICE AND METHOD

[75] Inventor: Akito Inoue, Chofu, Japan

[73] Assignee: Polytechs, Inc., Tachikawa, Japan

[21] Appl. No.: 104,217

[22] Filed: Aug. 10, 1993

[30] Foreign Application Priority Data

Aug. 10, 1992 [JP] Japan ..... 4-234187

[51] Int. Cl.[6] ..... C25D 13/22

[52] U.S. Cl. ..... 204/180.8; 204/299 EC; 204/301

[58] Field of Search ..... 204/180.8, 301, 204/299 EC

[56] References Cited

U.S. PATENT DOCUMENTS 4,711,709 12/1987 Inoue ..... 204/301

4,900,422 2/1990 Bryan et al. ..... 204/401

*Primary Examiner*—John Niebling
*Assistant Examiner*—Kishor Mayekar
*Attorney, Agent, or Firm*—Alan R. Loudermilk

[57] ABSTRACT

An electrodeposition painting cell and method utilizing a membrane electrode cell and membrane monitoring capability is disclosed. In the disclosed cell and method, the article to be painted constitutes the first electrode, and a second electrode is provided by a membrane electrode cell. An electrical current detection device and an electrical potential sensing device provide inputs to a computing device, which computes membrane resistance or membrane voltage drop, with the results thereof utilized to assess membrane degradation. A novel voltage sensing probe and method of use thereof also is disclosed.

20 Claims, 7 Drawing Sheets

FIG. 5 $\langle R_1 = 1\,[\Omega];\ R_2 = 8\,[\Omega];\ r = 0\,[\Omega]\rangle$

| E [V] | $R_K$ [Ω] | I [A] | $R_K \cdot I$ [V] | $R_1 \cdot I$ [V] | $R_2 \cdot I$ [V] |
|---|---|---|---|---|---|
| 100 | 1 | 10.0 | 10.0 | 10.0 | 80.0 |
| | 5 | 7.14 | 35.7 | 7.14 | 57.16 |
| | 11 | 5.0 | 55.0 | 5.0 | 40.0 |
| | 21 | 3.3 | 69.3 | 3.3 | 26.6 |

$\langle R_1 = 1[\Omega];\ R_2 = 8[\Omega];\ r = 10[\Omega] \rangle$

| E [V] | $R_K$ [Ω] | I [A] | $R_K \cdot I$ [V] | $R_1 \cdot I$ [V] | $R_2 \cdot I$ [V] | $r \cdot I$ [V] |
|---|---|---|---|---|---|---|
| 100 | 1 | 5 | 5.0 | 5.0 | 40 | 50 |
| | 5 | 4.2 | 21.0 | 4.2 | 33.6 | 42 |
| | 11 | 3.33 | 36.63 | 3.33 | 26.65 | 33.3 |
| | 21 | 2.5 | 52.5 | 2.5 | 20 | 25 |

ELECTRODEPOSITION PAINTING DEVICE AND METHOD

BACKGROUND OF THE INVENTION

1. Field of the Invention

The present invention relates to electrodeposition painting devices and methods, and more particularly to electrodeposition painting devices and methods employing a first electrode serving as an article to be coated and a second electrode provided as a membrane electrode device, and including a membrane condition sensing capability.

2. Description of the Prior Art

In electrodeposition painting, there generally are techniques that use anion-type paints and techniques that use cation-type paints. With either of the cation-type or anion-type techniques, generally the uniformity and adherence of the paint film on the painted subject is superior and pollutants are limited over other types of painting technologies. As a result, recently there have been many widely used applications for such electrodeposition painting such as in automatic paint processing of automobile bodies, especially in the metal undercoating or the last coating, etc., of the automobile bodies.

Of the paints used in electrodeposition painting, for anion-type paints, an example is a resin of molecular weight 200 made water soluble by adhering to it a carboxyl group. For cation-type paints, an example is a similar resin made water soluble by adhering to it an amino group. However, the degree of ionization of these water soluble paints after dissolving in water typically is minute. For this reason, at present, when using anion-type paints an alkaline neutralizer such as tri-ethylamine is mixed with the paint, and when using cation-type paints an acetic neutralizer such as acetic acid is mixed with the paint, thereby obtaining neutralization and increasing the degree of ionization in the water.

According to the behavior of the resin component of each paint, a neutralizer is mixed in to increase the degree of ionization. As the electrodeposition coating of the painted article progresses, however, the resin component of the paint in the solution is consumed and therefor decreases, so that the paint in the solution must be replenished from the outside. At the same time, neutralizer is added by the replenishment of the paint. For this reason, as the electrodeposition of the painted article advances along with the consumption and replenishment of the paint, the amine and/or acetic acid neutralizer tends to continuously accumulate, which can result in the re-dissolving of the painted surface or in the generation of pinholes, causing the efficiency of the electrodeposition painting to fall to a significant degree.

In order to improve on such inconveniences and inefficiencies, recently, for example as can be seen in Japanese Patent Publication 45-22231, an ion exchange membrane, etc., used as a membrane for extracting neutralizer (hereafter referred to as "membrane") separates the article to be coated (which is one of the electrodes, namely the first electrode) and the aqueous solution from the other electrode, and through the membrane amine and/or acetic acid neutralizer is osmotically extracted from the aqueous solution, preventing an undesirable accumulation of the neutralizer in the aqueous solution, putting into practical effect a so-called pH control.

In the above-described present-day example, however, even if an ideal acid removal balance is attained, the electrical resistance of the membrane in use progressively increases (with continuous use of up to several years) to 10 to 50 times its initial value. If left in this higher resistance condition, not only does the efficiency of the acid removal fall, but inconveniently the efficiency of the electrodeposition painting significantly falls as well.

For example, for the sake of convenience, let the electrical resistance of the interior of the membrane electrode device be 1 Ω (ohm), the electrical resistance of the membrane be 1 Ω, and the electrical resistance of the aqueous solution between the exterior of the membrane and the article to be painted be 8 Ω. Then, when the resistance of the membrane becomes 11 Ω, the electrical current flowing through the solution is halved. As a result, the efficiency of the electrodeposition painting from the starting point effectively is already halved. When the resistance of the membrane becomes 31 Ω, the current passing through the solution is decreased to ¼ of its initial value. As a result, the efficiency of the electrodeposition painting from the starting point effectively is already decreased to ¼ of the initial efficiency.

SUMMARY OF THE INVENTION

The present invention provides an electrodeposition painting device and method that improve on such present-day examples, especially by providing a device and method for observing the time-change in electrical resistance of the ion-exchange membrane, which is the membrane for extracting neutralizer, etc., and through which the whole electrodeposition system is maintained in a proper working order. With the present invention, the quality and efficiency of the electrodeposition painting may be established and maintained in excellent conditions.

In the present invention, a first electrode is provided in an electrodeposition bath, the first electrode serving as the article to be coated (e.g., an automobile car body). A second electrode corresponding to the first electrode also is provided, and by electrical conduction through an aqueous solution of film forming material (e.g., paint) in the electrodeposition bath in between the article to be coated and the second electrode, an electrodeposition painting device electrodeposits the film forming material on the article to be coated, with the second electrode constituting a membrane electrode device. The membrane electrode device of the second electrode comprises an electrode, a membrane for extracting neutralizer, the membrane osmotically extracting neutralizer from the aqueous solution attracted to the electrode material, and a fluid flowing mechanism to conduct or flush to the exterior of the device the neutralizer that was osmotically extracted through the membrane. Furthermore, included with the membrane electrode device is an electrical current detection device for the membrane electrode device, and a computing device that computes the electrical resistance of the membrane of the membrane electrode device based on the current detected by the electrical current detection device and the voltage applied to the membrane electrode device, and a data display that displays the output of the computer.

Also, included with the membrane electrode device may be an electrical potential sensor that detects the electrical potential of the exterior part of the membrane, the computing device computing the amount of voltage drop across the membrane based on an electrical potential value detected by the electrical potential sensor and the voltage applied to the membrane electrode device.

Accordingly, it is an object of the present invention to provide an electrodeposition painting device and method that improve on present-day devices, especially in enabling the observation of the time-change in electrical resistance of the ion exchange membrane.

It is another object of the present invention to provide such an electrodeposition painting device and method that utilize a computing device and electrical current detection device to determine the electrical resistance of the membrane, and also a display to display the output of the computing device.

It is yet another object of the present invention to provide such an electrodeposition painting device and method that utilize a computing device and electrical potential sensor to determine the voltage drop across the membrane, and also a display to display the output of the computing device.

It is still another object of the present invention to provide such an electrodeposition painting device and method that utilize a computing device and a combination of electrical current detection devices and/or electrical potential sensors and switching circuitry, which may include a degradation judging circuit to determine when the membrane has degraded to a certain level, and a display to display the output of the computing device.

Finally, it is an object of the present invention to provide a voltage sensing probe and method of use thereof for determining the degree of degradation of the membrane in a membrane electrode device.

BRIEF DESCRIPTION OF THE DRAWINGS

The above-mentioned features and objectives of the present invention will become more apparent by reference to the following description taken in conjunction with the accompanying drawings, in which:

FIG. 5 is a table illustrating the change in electrical potential for various points of FIG. 4;

DETAILED DESCRIPTION OF THE PREFERRED EMBODIMENTS

Figure 1:
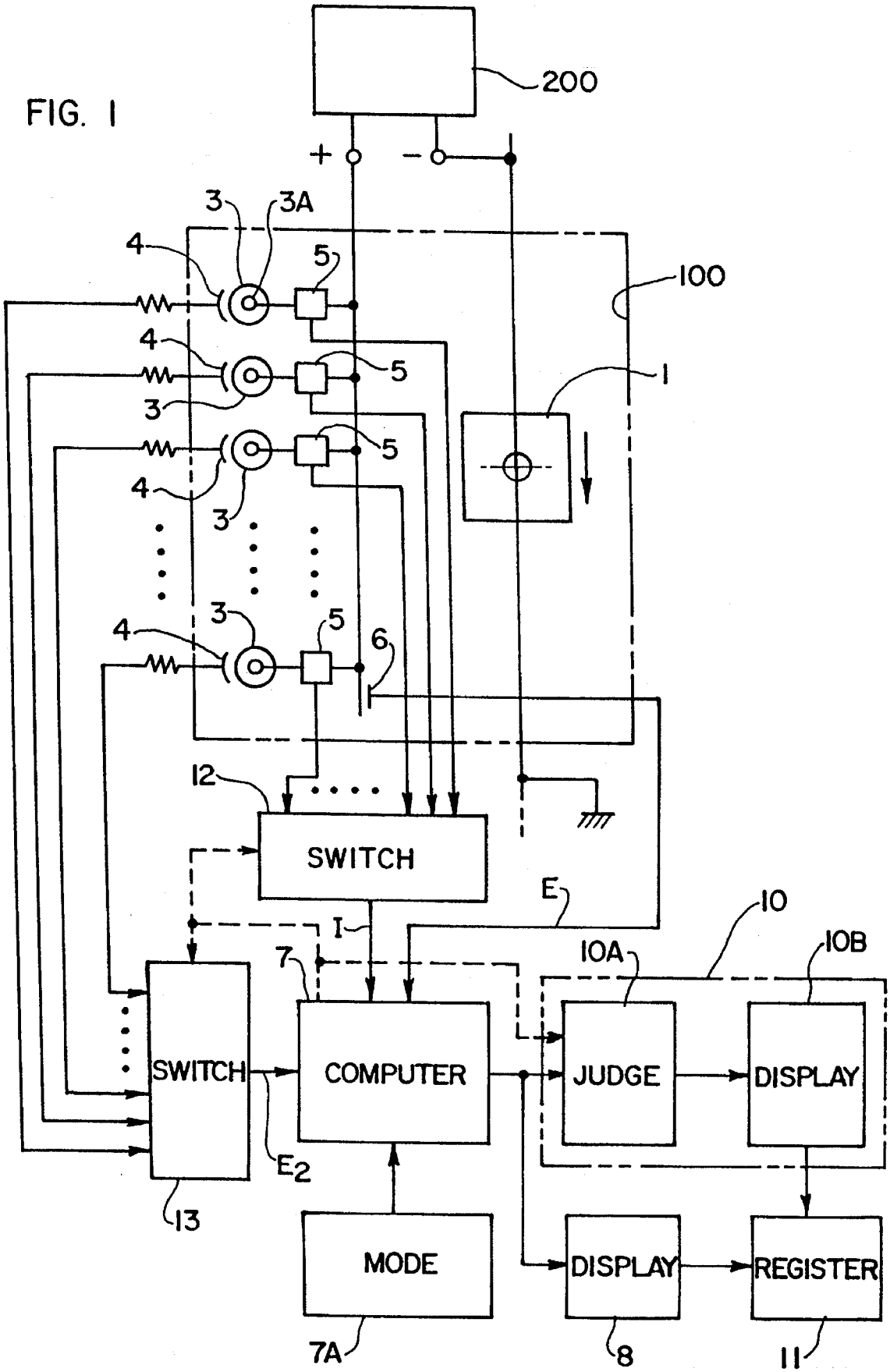
FIG. 1 is a diagram illustrating a preferred embodiment of the present invention.

A detailed description will now be provided of various preferred embodiments of the present invention with reference to the drawings.

As an example of the present invention, embodiments will be explained of a cation-type electrodeposition painting device that uses a cation-type paint. First, with reference to FIGS. 1 and 2, let object to be painted 1 (sometimes referred to herein as "painted subject 1") be the cathode and each of multiple tubular electrodes 3A of each of multiple membrane electrode devices 3 be anodes, and apply direct current voltage source 200 to the cathode and anodes as shown. After application of the dc voltage from voltage source 200, the electrodeposition painting begins, and the paint resin component and pigment's colloid particles that have a positive charge in aqueous solution W move toward the cathode, painted subject 1, and after adhering and discharging on the surface of painted subject 1, the solids of the paint cohere to form a paint film.

Then, in the aqueous solution, acetic acid that has negative charge will accumulate, and as the electrodeposition painting is underway, the acetic acid also starts to move toward tubular electrodes 3A. Here, because in each membrane electrode device 3 an anion membrane (membrane 3B) is provided which readily passes acetic acid molecules that have a negative charge, the acetic acid molecules attracted to the tubular electrodes of membrane electrode devices 3 of positive electrical potential will follow the line of electronic force and readily pass through membrane 3B to tubular electrode 3A, where they will discharge. In this case, since the neutralizer in low concentration will almost completely ionize, when electrical current is running the neutralizer will be pulled toward the anode, and will accumulate between tubular electrode 3A and membrane 3B.

Between tubular electrode 3A and membrane 3B, a carrier liquid such as pure water is forcefully circulated. As a result, the accumulated acetic acid may be continuously discharged with the carrier liquid to the exterior of membrane electrode device 3. The type of carrier liquid flow mechanism is not critical to the present invention. So long as the desired flushing-discharging of the neutralizer to the exterior of membrane electrode device 3 is accomplished, any type of suitable carrier liquid flowing mechanism (or other mechanism to prevent undesired accumulation of neutralizer) may be utilized with the present invention.

Now, in this series of ongoing processes of electrodeposition painting, the total of the electrical resistances may be computed and output by computer 7 based on the current value detected by electrical current detecting device 5 and the voltage applied to membrane electrode device 3. Also, as may be needed with the particular application, the electrical resistance of membrane 3B may be output from computer 7 in a different form. That is, the change in the voltage drop across membrane 3B may be computed based on information from electrical potential detection sensor 4 that detects the electrical potential of the exterior side of membrane 3B and the voltage value applied to membrane electrode device 3. Furthermore, as may be needed with the particular application, the electrical resistance of membrane 3B may be computed and output by computer 7 based on the voltage drop across membrane 3B and an electrical current value detected by electrical current detection device 5.

Figure 2A:
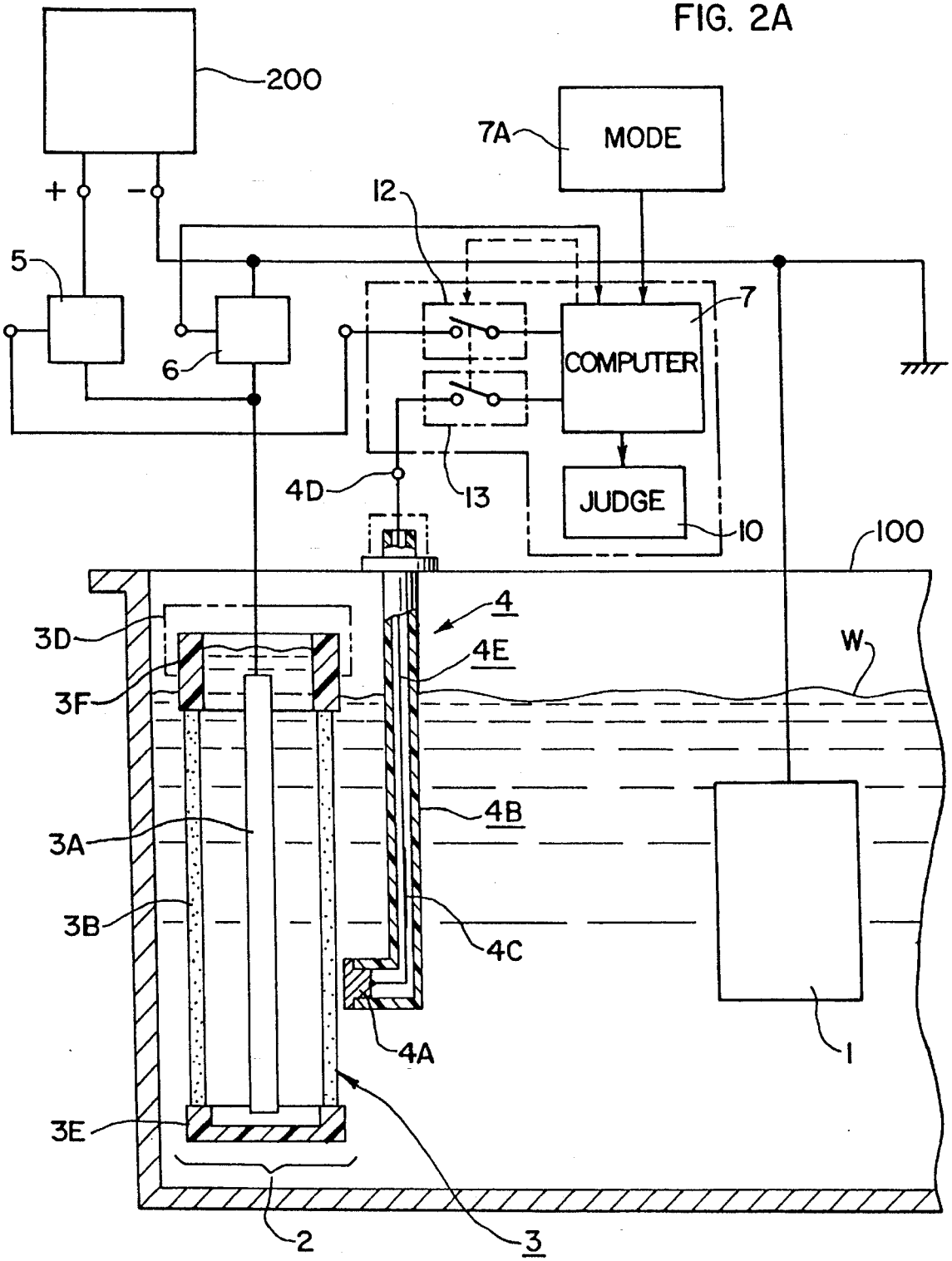
FIG. 2A is a diagram illustrating a specific example of a membrane electrode device and electrical potential sensor that may utilized in the embodiment of FIG. 1.

Below is a more detailed explanation of a preferred embodiment of the present invention discussed with reference to FIGS. 1 to 3. The embodiments illustrated in FIGS. 1 to 3 are examples of a cation-type electrodeposition painting device that uses a cation-type paint. In other embodiments, anion-type electrodeposition painting devices and paints are utilized.

The preferred embodiment illustrated in FIG. 1 is equipped with a first electrode arranged in electrodeposition bath 100 that hangs painted subject 1, and is also equipped with a second electrode assembly 2 (comprised of multiple membrane electrode devices 3 in the preferred embodiment as more fully discussed below) arranged to correspond to painted subject 1. In electrodeposition bath 100 an aqueous solution W of film forming material (aqueous solution of cation-type paint) is provided. From direct current source voltage 200 applied between painted subject 1 and second electrode assembly 2 through aqueous solution W, through the movement of electricity (electrophoresis) the film forming material in aqueous solution W is electrodeposited on painted subject 1.

Second electrode assembly 2 in the preferred embodiment comprises multiple membrane electrode devices 3. Each of membrane electrode devices 3, as illustrated in FIG. 2, are equipped with tubular electrode 3A of electrode material made from anti-corrosive, conductive material, membrane 3B for extracting neutralizer (because cation-type paint is used, an acid such as acetic acid is used as the neutralizer) from aqueous solution W that is attracted to tubular electrode 3A. A liquid conducting mechanism (not explicitly shown) is provided to flow a carrier liquid (pure water or an anolyte of low acid concentration) into membrane electrode cell 3 that serves to conduct or flush to the exterior neutralizer (in this case acid) that has been osmotically extracted by membrane 3B. In the preferred embodiment, membrane 3B is an anion exchange membrane. Symbol 3E illustrates a bottom cover of membrane electrode device 3. Symbol 3F illustrates membrane support material for the upper portion of membrane electrode device 3. On membrane support material 3F is cap 3D that may be freely attached or removed. Bottom cover 3E, membrane support material 3F, and cap 3D are all made from insulating material in the preferred embodiment.

On the exterior part of the membrane for extracting neutralizer (membrane 3B) is arranged electrical potential sensor 4. Electrical potential sensor 4 consists in the preferred embodiment of sensor electrode 4A that is arranged facing the exterior of membrane 3B, tubular support material 4B that is made of insulating material fitted on one end of sensor electrode 4A, high resistance material 4C positioned in tubular support material 4B and connected in series with sensor electrode 4A, and signal line 4E connected in series with high resistance material 4C that transmits electrical potential information detected at sensor electrode 4A to sensor output terminal 4D provided at the other end of tubular support material 4B. In operation, the electrical potential on the exterior of membrane 3B is effectively sensed by sensor electrode 4A, and through high resistance material 4C is transmitted to sensor output terminal 4D. If sensor output terminal 4D is inadvertently shorted to other material or grounded, high resistance material 4C operates to effectively prevent high current flow to the outside (i.e., it acts as a current limiting resistance).

High resistance material 4C also may be utilized in a preferred manner as follows. Detecting of the voltage on the exterior of membrane 3B through a suitably high resistance such as high resistance material 4C serves to reduce the amount of paint that may deposit on the face of sensor electrode 4A, as the high resistance of high resistance material 4C reduces current flow to the face of sensor electrode 4A. In the preferred embodiment, high resistance material 4C may have an impedance of up to, or on the order of, 100KΩ or more (in part, the impedance of high resistance material 4C will be determined by the impedance of the voltage measuring element of computer 7, as more fully discussed below). Any small amount of paint depositing on the face of sensor electrode 4A may readily re-dissolve into electrodeposition bath 100 after sensing of the exterior voltage of membrane 3B. As a result of this re-dissolving effect, high impedance (low current) voltage sensing of a periodic nature through sensor electrode 4A is preferable in many applications (the periods during which voltage measurements are not being taken typically will allow any small amount of deposited paint to re-dissolve into the bath).

Figure 2B:
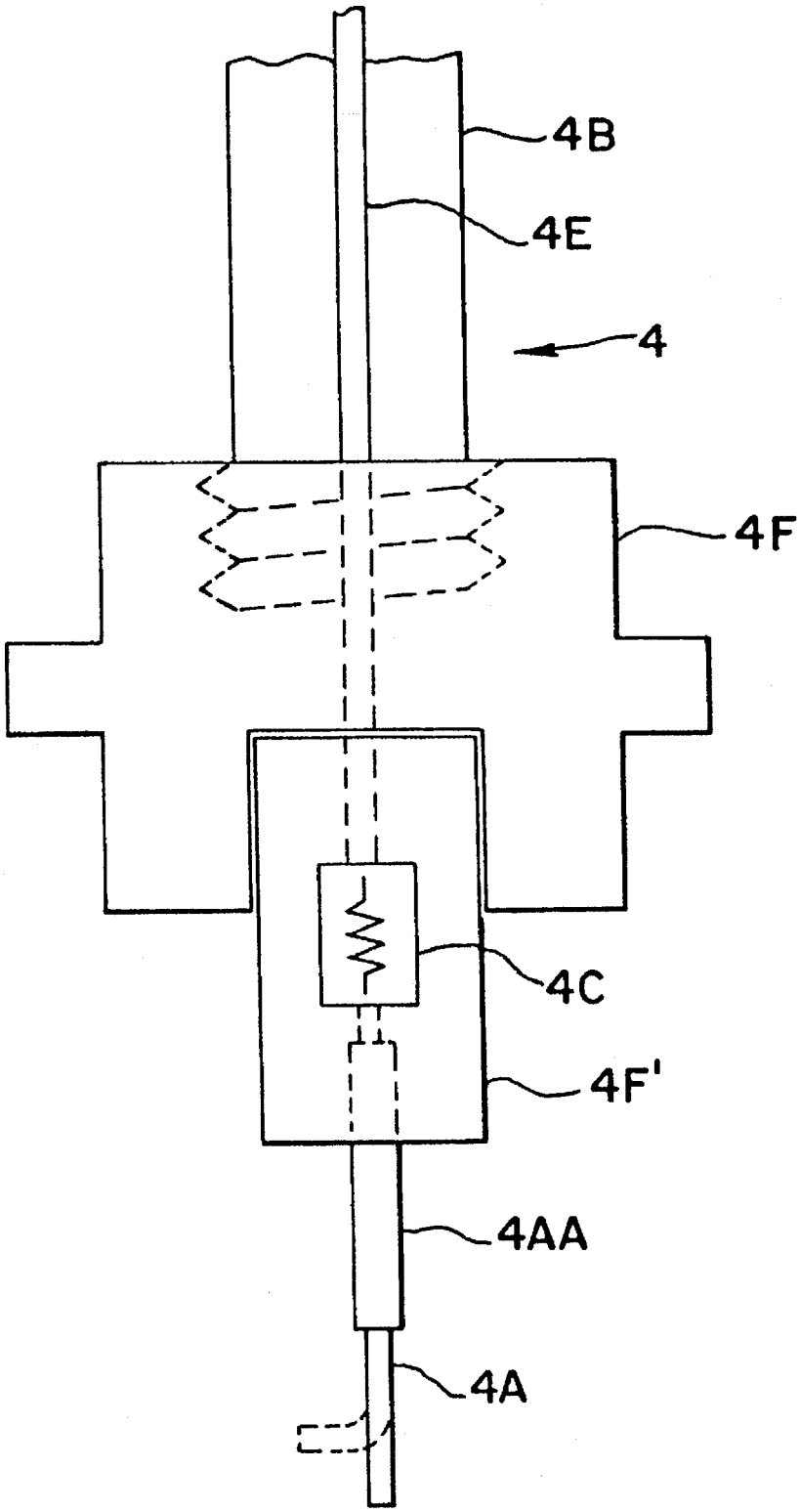
FIG. 2B is a diagram illustrating in more detail a preferred embodiment of an electrical potential sensor.
Figure 3:
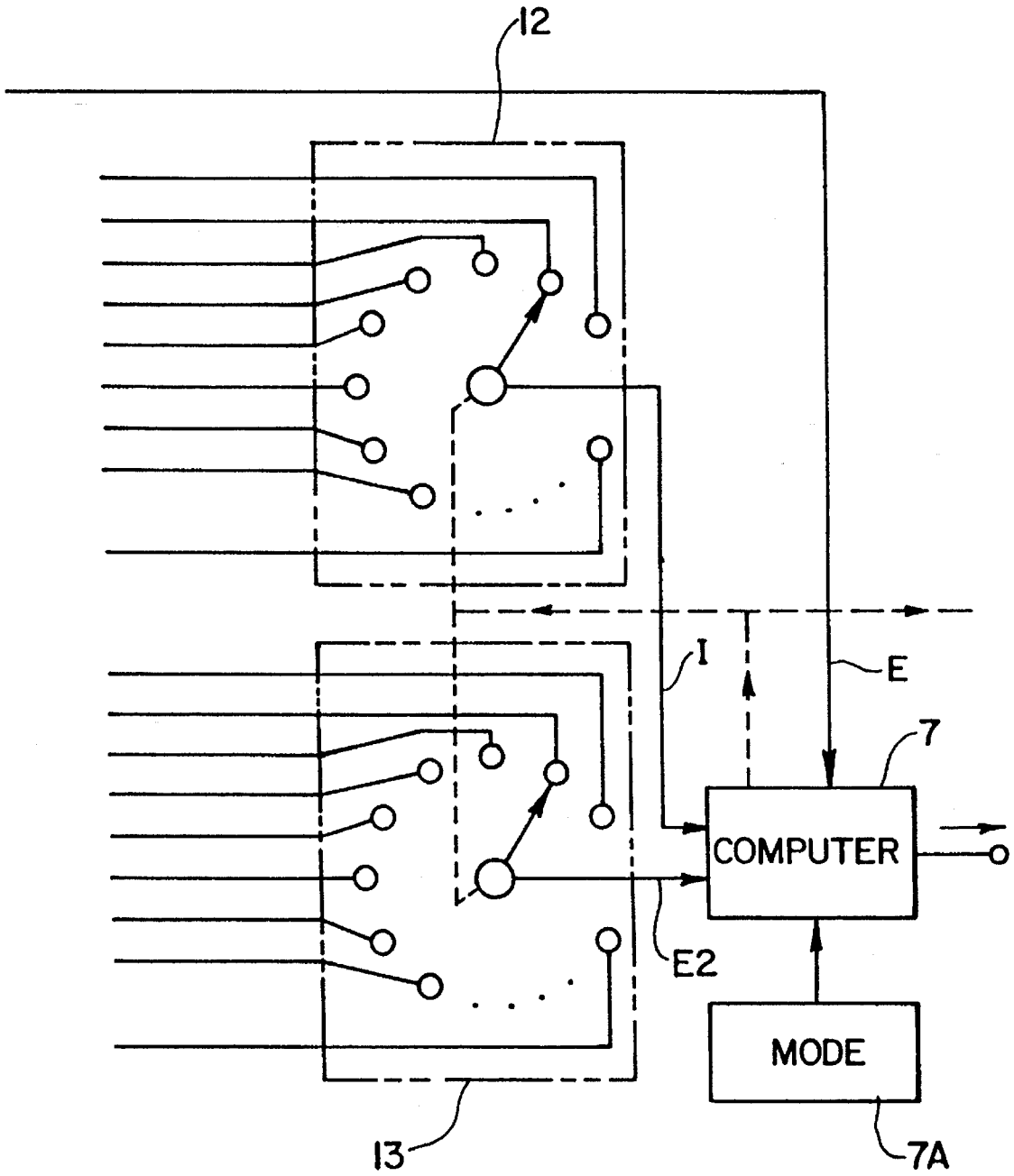
FIG. 3 is a diagram illustrating a preferred embodiment of switching circuits that may be utilized in the embodiment of FIG. 1.

FIG. 2B diagrammatically illustrates in more detail a preferred embodiment of electrical potential sensor 4. Sensor housing 4F consists of a non-conductive housing, which in the preferred embodiment may be a standard plastic pipe fitting, which may be threaded on one end for ease of connection to tubular support material 4B. Auxiliary housing 4F' is connected to sensor housing 4F such as by way of a glue or epoxy fitting.

Auxiliary housing 4F', which consists of a length of plastic pipe or the like, provides an enclosure for high resistance material 4C, which in the illustrated preferred embodiment is a resistor of suitably high resistance such as on the order of 100KΩ or more, and may be within a range of 50–200KΩ, or 50–500KΩ, etc. Electrically connected to high resistance material 4C is sensor electrode 4A, which in the illustrated preferred embodiment is a suitable length of number 316 stainless steel conductor, with a diameter of about 1 mm in the preferred embodiment (other useful diameters may be in the range of about 0.05 mm–5 mm). Sensor electrode 4A is covered for a certain length by sensor sleeve 4AA, which in the preferred embodiment is a non-conductive material such as teflon. Sensor electrode 4A projects in an exposed manner from sensor sleeve 4AA, and may extend straight from sensor sleeve 4AA or may be appropriately bent as indicated for purposes of optimum voltage sensing for the particular application. It may be noted here that sensor electrode 4A is constructed and positioned to be a short distance (such as about 5–25 mm, or 15–20 mm in the preferred embodiment, or at least 10 mm) from the external surface of membrane 3B. This construction and positioning allows for sensing of the membrane voltage without physical contact between sensor electrode 4A and membrane 3B, which is intended to prevent damage to membrane 3B and/or sensor electrode 4A. In any event, such sensing should be conducted to avoid such damage.

Connected to the opposite end of the resistor comprising high resistance material 4C is a suitable conductor (such as a flexible wire) which comprises signal line 4E. Signal line 4E passes up through tubular support material 4B, which typically extends up and out of the aqueous paint solution. High resistance material 4C and its connection to signal line 4E and sensor electrode 4A may be potted or encased in a suitable material such as epoxy as in the preferred embodiment. In other embodiments, other types of housing and enclosure arrangements are utilized for sensor electrode 4A and/or high resistance material 4C and/or signal line 4E. In still other embodiments, high resistance material 4C is positioned outside of the portion of the electrical potential sensor 4 that is placed inside of the aqueous solution, and may be part of the high impedance voltage sensing circuitry utilized for detecting the voltage sensed by sensor electrode 4A (discussed more fully below in connection with computer 7).

Electrical potential sensor 4 in the embodiments discussed above illustrate embodiments where electrical potential sensor 4 may be fixed in electrodeposition bath 100; however, in other embodiments electrical potential sensor 4 may be freely attached and removed as regards to electrodeposition bath 100 and/or membrane electrode device 3, or it may be more permanently integrated with membrane electrode device 3. For purposes of practicing the present invention, whether, and the extent to which, electrical potential sensor 4 is fixed in electrodeposition bath 100 or to membrane electrode device 3 is not critical.

Figure 2C:
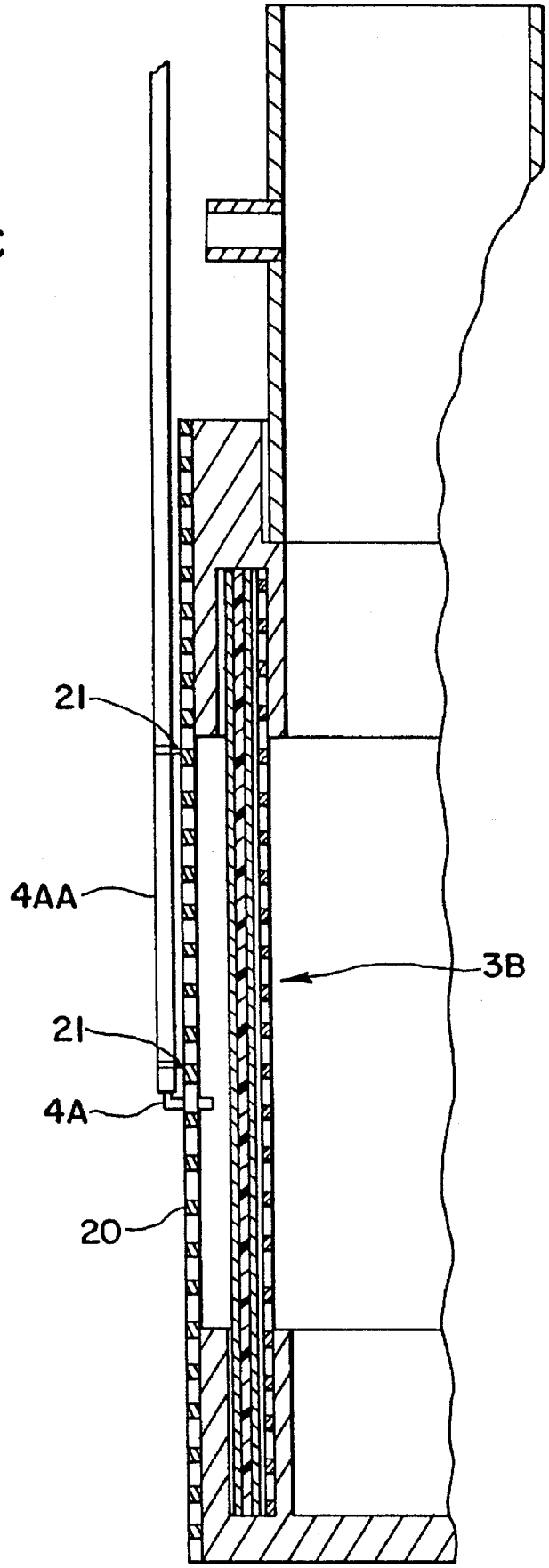
FIG. 2C is a diagram illustrating an example of how an electrical potential sensor may be attached to a membrane electrode cell.

Yet another example of how electrical potential sensor 4 may be applied is illustrated in FIG. 2C. FIG. 2C illustrates a guard for preventing physical contact with the membrane electrode cell. Such a guard is disclosed in U.S. Pat. No. 5,213,671. FIG. 2C illustrates sensor sleeve 4AA and sensor electrode 4A attached to guard 20 by connectors 21. In the illustrated embodiment, electrode sensor 4A is bent to project through an opening of guard 20 towards the surface of membrane 3B (in the illustrated embodiment, membrane 3B comprises a multi-layer (e.g., cloth-membrane-cloth-membrane support) structure such as is disclosed in U.S. Pat. No. 5,213,671, although the type of membrane structure is not critical for purposes of the present invention). Sensor sleeve 4AA and sensor electrode 4A may be connected to guard 20 by any suitable means, such as gluing, wire or wrapping or other available clamps or connectors.

Each of membrane electrode devices 3 may be equipped with a current detection device 5 (see FIG. 1) that individually detects current flow between each membrane electrode device 3 and painted subject 1. Applied voltage detection device 6 is provided to detect voltage E applied commonly to each membrane electrode device 3. From the current values detected by current detection devices 5 and also from inputs such as electrical potential sensors 4, computer 7 may compute the electrical resistance of membrane 3B, and the drop in electrical potential corresponding to membrane 3B, etc.

In the preferred embodiment, computer 7 has a first computing function that computes the resistance between the electrode and painted subject 1 based on current value Ix detected by electrical current detection device 5 and voltage E (output of applied voltage detection device 6) applied to membrane electrode device 3. Also in the preferred embodiment, computer 7 has a second computing function that computes the drop in voltage value Δ E of membrane 3B based on electrical potential value Ex detected by electrical potential sensor 4 and voltage E detected by applied voltage detection device 6. Computer 7 in the preferred embodiment also has a third computing function that computes electrical resistance Rk of membrane 3B of membrane electrode device 3 based on current value Ix detected by electrical current detection device 5 and voltage E detected by applied voltage detection device 6 and electrical potential value Ex detected by electrical potential sensor. For example, first and second computing functions may be set by outside commands from operating mode setting device 7A; in other embodiments, however, these functions may be activated by an automatic setting. In other embodiments, computer 7 may include only one, some or all of the above-discussed computing functions, and possibly other functions as well.

The first computing function in computer 7 may be understood as follows. Because electrical resistance $R_1$ of the anolyte in membrane electrode device 3 and electrical resistance $R_2$ of aqueous solution W in electrodeposition bath 100 are known or may be calculated in at least an approximate manner, then based on current I that flows between each membrane electrode device 3 and painted subject 1 (in reality each membrane electrode device 3 differs) and voltage E detected by applied voltage detection device 6, at the time just after the start of electrodeposition painting (when the electrical resistance r of paint film on painted subject 1 is substantially equal to 0 Ω), the electrical resistance $R_k$ of membrane 3B may be computed as follows:

$$R_k=[E-I\ (R_1+R_2)]/I\ [\Omega]$$

Then, depending on the size of $R_k$, the degree of degradation of membrane 3B may be assessed based on a fixed standard, or through experience.

The second computing function in computer 7 may be understood as follows. Based on electrical potential value Ex detected by electrical potential sensor 4 and voltage value E detected by applied voltage detection device 6, the voltage drop Δ E of membrane 3B may be computed as follows:

$$\Delta E=E-Ex\ [V]$$

Then, depending on the size of Δ E, the degree of degradation of membrane 3B may be assessed based on a fixed standard, or through experience.

Furthermore, the third computing function in computer 7 may be understood as follows. That is, with the inputs of current value Ix detected by electrical current detection device 5 and voltage value E detected by applied voltage detection device 6 and electrical potential value Ex detected by electrical potential sensor 4, then based on $$\Delta E=E-Ex[V]$$

$$R_k=\Delta E/Ix\ [\Omega]$$

the voltage drop value Δ E of membrane 3B, along with electrical resistance $R_k$ of membrane 3B, may be computed in real time.

For each of the computing functions of computer 7, the calculation results of computer 7, along with the input data, may be displayed with data display 8.

Also, arranged together with computer 7 is operating mode setting device 7A for setting the operating mode of computer 7, degradation judging circuit 10 that judges the degree of degradation of membrane 3B based on the calculation results of computer 7, and register 11 that records the output data of degradation judging circuit 10 and computer 7. Degradation judging circuit 10 provides judging circuit 10A that judges the degree of degradation of membrane 3B based on a reference value already set corresponding to each operating mode of computer 7, and a display 10B that displays the output of degradation judging circuit 10A.

Judging circuit 10A, when putting into action the first or third operation functions of computer 7, provides for judging when the electrical resistance $R_k$ of membrane 3B surpasses a reference resistance value, for example 10 times its initial value, whereupon use is disabled (generation of a "degradation condition"). Also, when putting into action the second operating function, judging circuit 10A provides for judging when the voltage drop across membrane 3B surpasses a reference voltage value, for example 5 times its initial value, whereupon use is disabled (also a generation of a "degradation condition").

Between computer 7 and each electrical current detection device 5 is provided first switching circuit 12. First switching circuit 12 is a current switching device that sends (in the preferred embodiment with a fixed timing) to computer 7 the output of each electrical current detection device 5. Also, between computer 7 and each electrical potential sensor 4 is provided second switching circuit 13. Second switching circuit 13 is a sensor signal switching device that sends (in the preferred embodiment with a fixed timing) to computer 7 the output of each electrical potential sensor 4. First and second switching circuits 12 and 13, as shown in FIG. 3, perform switching that in the preferred embodiment is synchronized with a fixed clock output from computer 7, and for the same membrane electrode device 3 are constructed so as to synchronously input to computer 7 the appropriate detected current and voltage information. While synchronized and fixed timing interaction between switching circuits 12 and 13 and computer 7 are provided in the preferred embodiment, many other types of switching arrangements are utilized in other embodiments of the present invention, such other types of switching arrangements providing the desired controlled connection of the appropriate current and voltage inputs to computer 7.

Computer 7 may be any suitable computing device or unit that can reliably receive and process the outputs of electrical current detecting devices 5, electrical potential sensors 4 and applied voltage detection device 6, and that can also perform the desired calculations and also interact in an appropriate controlled manner with, for example, degradation judging circuit 10, data display 8, operation mode setting device 7A and first and second switching circuits 12 and 13. Computer 7 may be implemented in analog or digital form (so long as compatible with the other elements of the system), and in the case of digital form may be implemented with a digital computer or microprocessor-based circuit. In the case of electrical potential sensor 4, in the preferred embodiment computer 7 also includes a suitable high impedance (up to, or on the order of, 10MΩ or more, the precise value of which may be selected depending upon the resistance of high resistance material 4C discussed above) voltage measuring unit for high impedance periodic or continuous sensing of the voltage signals from electrical potential sensors 4. Similar capability is provided in computer 7 for other elements of the system as needed to achieve the benefits, objectives and purposes of the present invention as disclosed herein.

Next, the overall performance of the above example will be explained. First, if painted subject 1 is a cathode while each of multiple membrane electrode devices 3 are anodes and direct current voltage source 200 is applied, then electrodeposition painting starts, and the paint resin components that have a positive charge in aqueous solution W and the colloid particles of the pigment move toward cathode painted subject 1, and after adhering to the surface of painted subject 1 and discharging, the solids of the paint cohere to form a paint film.

Meanwhile, in the aqueous solution, acetic acid that has negative charge accumulates, and, at the same time that the electrodeposition painting starts, this acetic acid starts to move toward tubular electrodes 3A of membrane electrode devices 3. In each membrane electrode device 3, because an anion membrane is provided as membrane 3B that easily passes acetic acid molecules having a negative charge, the acetic acid molecules attracted to the tubular electrode of membrane electrode device 3 (having positive potential) follow the line of electronic force, readily passing through the anion exchange membrane to tubular electrode 3A where they are discharged. In this case, because the discharged neutralizer in low concentration almost completely ionizes, while electricity is conducting neutralizer will be drawn to the anode and will accumulate between tubular electrode 3A and membrane 3B.

In this case, in between tubular electrode 3A and anion exchange membrane, as aforementioned, for example a carrier liquid such as pure water is forcefully circulated. As a result, the accumulated acetic acid, along with the carrier liquid, may be continuously discharged to the outside.

In this progression of events in the electrodeposition painting process, membrane 3B of each membrane electrode device 3 progressively degrades and the electrical resistance increases. If this phenomenon is left to itself, even though the same voltage is applied, the efficiency of the electrodeposition painting significantly falls. In the preferred embodiment, such degradation may be detected beforehand and displayed through computer 7 and degradation judging circuit 10, whereupon appropriate maintenance action may be taken.

An example of the relationship between the degree of degradation of membrane 3B (an increase in electrical resistance value $R_k$) in the above-described embodiment and the efficiency of the electrodeposition painting will now be explained. Here, for the sake of convenience, let the electrical resistance $R_1$ of anolyte Ko in membrane be 1 Ω and electrical resistance $R_2$ of aqueous solution W in electrodeposition bath 100 be 8 Ω. Then, the results of examining at the instance of the start of electrodeposition painting (when electrical resistance r of paint film of painted subject 1 is substantially zero Ω) are shown in FIGS. 4 and 5.

Figure 4:
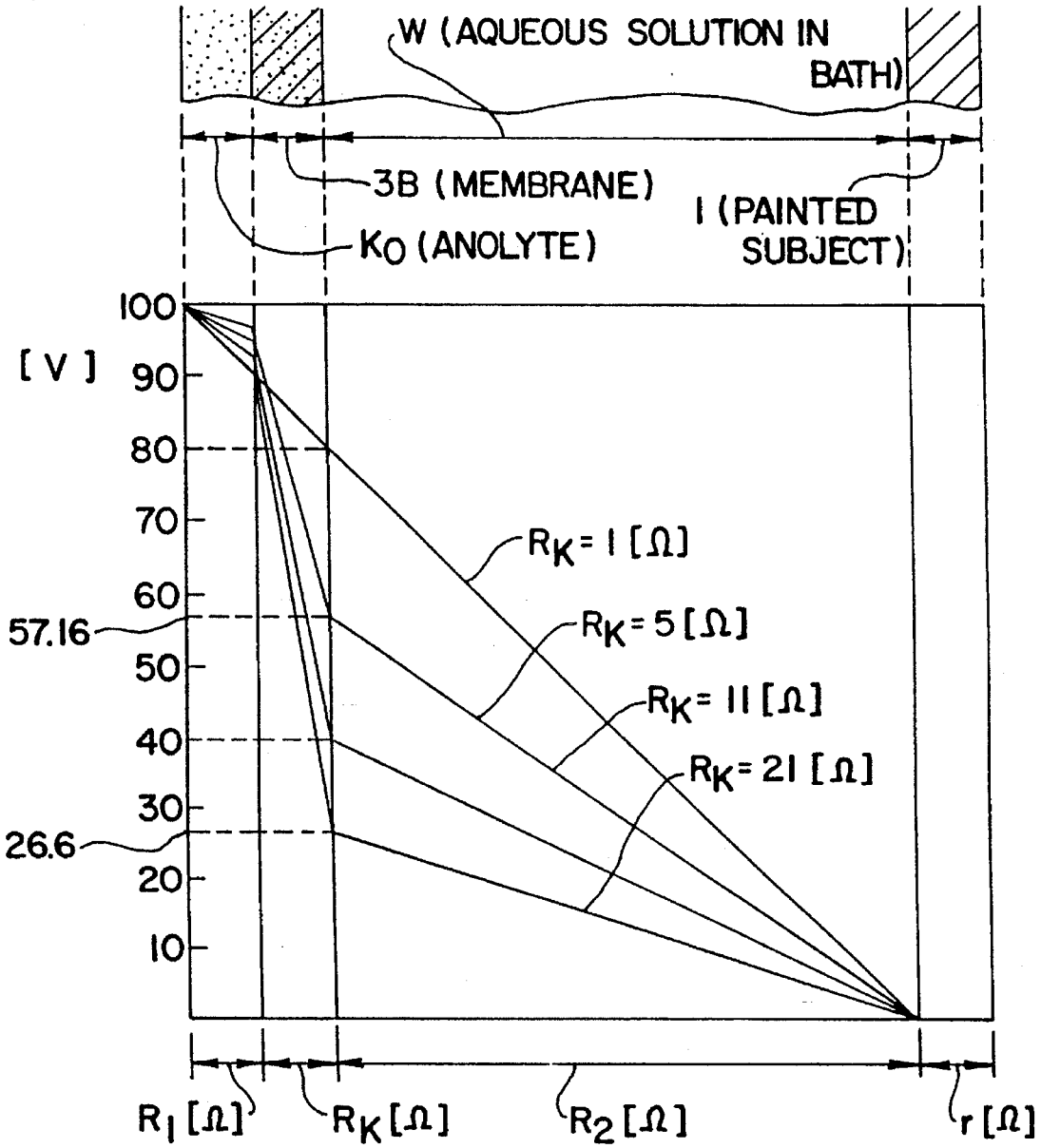
FIG. 4 is a figure illustrating the change in electrical potential as a function of membrane degradation (change in resistance) for the condition when there is zero paint film on the article to be coated.

As shown in FIGS. 4 and 5, in this case, as the degradation of electrical resistance $R_k$ of membrane 3B advances to $R_k$=5 Ω, the electrical current drops from an initial 10 amperes to about 7.1 amperes, and the voltage between membrane 3B in aqueous solution W and painted subject 1 drops from an initial 80 volts to about 57.1 volts (the voltage drop of membrane 3B is about Δ E= 35.7 volts, or an increase of around 3.5 times its initial value). Furthermore, as the degradation of electrical resistance $R_k$ of membrane 3B advances and $R_k$=11 Ω, the electrical current becomes 5 amperes, and the voltage between membrane 3B in aqueous solution W and painted subject 1 drops from an initial 80 volts to 40 volts (the voltage drop of membrane 3B is Δ E=55 volts, or an increase of about 5 times its initial value). In such conditions, it can be seen that the efficiency of the electrodeposition painting effectively is halved.

For this reason, in such a case (just after the start of electrodeposition painting), the degradation judging resistance reference value of judging circuit 10A is set, for example, at $R_k$=10 Ω (a fixed value of less than 5 times the initial voltage drop of membrane 3B), so that the inconveniences when the efficiency of electrodeposition painting drops below 50% may be avoided.

Next, as electrodeposition painting advances, the case where the electrical resistance r of the paint film of painted subject 1 becomes 10 Ω will be examined. The results of this examination are shown in FIGS. 6 and 7.

Figures 6, 7:
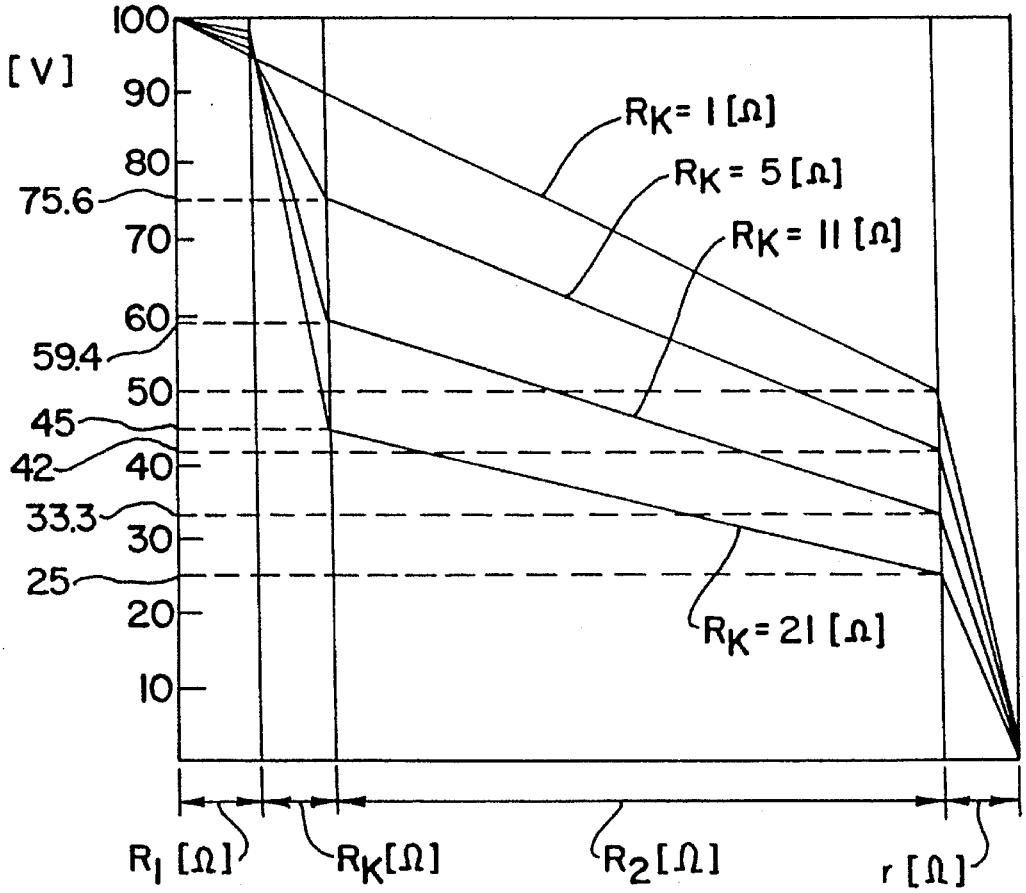
FIG. 6 is a figure illustrating the change in electrical potential as a function of membrane degradation (change in resistance) for the condition when there is paint film having 10 Ω of resistance on the article to be coated.
FIG. 7 is a table illustrating the change in electrical potential for various points of FIG. 6.

As shown in FIGS. 6 and 7, in this case, as the degradation of electrical resistance $R_k$ of membrane 3B advances to $R_k$=5 Ω, the electrical current drops from an initial 5 amperes to about 4.2 amperes, and the voltage between membrane 3B in aqueous solution W and painted subject 1 drops from an initial 40 volts to about 33.3 volts (the voltage drop of membrane 3B is about Δ E=21 volts, or an increase of around 4.2 times its initial value). In this case, the drop in potential of paint film of painted subject 1 is about 42 volts. Furthermore, as the degradation of electrical resistance $R_k$ of membrane 3B advances to $R_k$=11 Ω, the electrical current drops to about 3.33 amperes, and the voltage between membrane 3B in aqueous solution W and painted subject 1 drops from an initial 40 volts to about 26.7 volts (the voltage drop of membrane 3B is about Δ E=36.7 volts, or an increase of about 7.3 times its initial value). In this case, the potential drop of painted film of painted subject 1 is 33.3 volts. Then further, as the degradation of electrical resistance $R_k$ of membrane 3B advances to $R_k$=21 Ω, the electrical current becomes 2.5 amperes, and the voltage between membrane 3B in aqueous solution W and painted subject 1 drops from an initial 40 volts to 20 volts (the voltage drop of membrane 3B is about Δ E=52.5 volts, or an increase of about 10 times its initial value). In this case, the potential drop of paint film of painted subject 1 is 25 volts. In these conditions, it can be seen that the efficiency of electrodeposition painting effectively is halved.

For this reason, for example by setting (just after the start of electrodeposition painting) the degradation judging reference value of judging circuit 10A to $R_k$=10 Ω (a fixed value for less than 5 times the initial voltage drop of membrane 3B), the inconveniences of having the efficiency of electrodeposition painting drop below 50% may be avoided.

Here, if we compare the multiplying factor of voltage drop Δ E of membrane 3B in the case where a paint film of 10 Ω is formed on painted subject 1 (see FIG. 7) to the case where the paint film has not been formed (see FIG. 5), the case where a paint film is formed on painted subject 1 has a larger multiplying factor for the voltage drop of membrane 3B. Therefore, even by using as a reference the case where a paint film is not formed on painted subject 1 (i.e., at the beginning of electrodeposition painting of an article) and using this reference to set the degradation judging reference value of judging circuit 10A, no particular inconveniences will result.

In this way, degradation judging circuit 10 may judge the output information of computer 7 based on a fixed degradation judging reference value and is capable of providing to the outside an output indicating degradation of the membrane, whereupon appropriate maintenance or other action may be taken.

In the above-described embodiments, the use of multiple membrane electrode devices 3 has been discussed, although in other embodiments only a single membrane electrode device 3 is utilized. In such embodiments, first and second switching circuits 12 and 13 are not needed. In addition, in other embodiments non-tubular membrane electrode cells are utilized with the present invention.

Also in the above-described embodiments, computer 7 has a structure providing for operating functions first through third, but in other embodiments these operating functions are provided with three computers 7, using them separately according to the need of the particular application. In other embodiments only one or more (but not all) of the disclosed functions are provided by computer 7. Also, as for the output information of computer 7, often a human operator through experience can evaluate the output information accordingly, and in other embodiments degradation judging circuit 10 is not needed. Also, in embodiments where computer 7 is made only with the first operation function, electrical potential sensor 4 may not be required.

The present invention may be constructed and operated as discussed above, and from this, without having to remove the membrane electrode device or await for unsatisfactory operation of the electrodeposition system, information regarding degradation of the membrane can quickly and efficiently be measured. As a result, a step further in efficiency of electrodeposition painting may be made, which can provide for a superior electrodeposition painting device and method not available in other systems.

Although various preferred embodiments of the present invention have been disclosed for illustrative purposes, those skilled in the art will appreciate that various modifications, additions and/or substitutions are possible without departing from the scope and spirit of the present invention as disclosed in the claims.

I claim:

1. An electrodeposition coating system comprising a first electrode suspended in an electrodeposition bath as an article to be coated, a second electrode provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein the second electrode comprises a membrane electrode comprising an electrode having a voltage applied thereto, a membrane having means for extracting neutralizer that is attracted to the electrode from the aqueous solution, the system further comprising a current detecting device, a computing means for computing the resistance of the membrane depending upon on information derived from the current detecting device and the voltage that is applied to the membrane electrode, and a display device for displaying the computed resistance of the membrane.

2. An electrodeposition coating system comprising a first electrode suspended in an electrodeposition bath as an article to be coated, a plurality of second electrodes provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein the second electrodes comprise membrane electrodes each of which comprises an electrode having a voltage applied thereto, a membrane having means for extracting neutralizer that is attracted to the electrode from the aqueous solution, the system further comprising a plurality of current detecting devices for detecting current flow through the membrane electrodes, a computing means for computing the resistances of each the membranes of the membrane electrode depending upon information derived from the current detecting devices and the voltage that is applied to the electrodes, and a display device for displaying the computed resistances of the membranes.

3. The electrodeposition coating system of claim 2, further comprising a switching device for switchably providing information derived from the current detecting devices to the computing means.

4. The electrodeposition coating system of claim 1, further comprising means for generating a signal if the resistance of the membrane computed by the computing means is greater than a reference value.

5. An electrodeposition coating system comprising a first electrode suspended in an electrodeposition bath as an article to be coated, a second electrode provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein the second electrode comprises a membrane electrode comprising an electrode having a voltage applied thereto, a membrane having an outer side and having means for extracting neutralizer that is attracted to the electrode from the aqueous solution, the system further comprising a potential detecting device positioned on the outer side of the membrane of the membrane electrode, a computing means for computing the voltage drop across the membrane depending upon information derived from the potential detecting device and the voltage that is applied to the electrode, and a display device for displaying the computed voltage drop across the membrane.

6. An electrodeposition coating system comprising a first electrode suspended in an electrodeposition bath as an article to be coated, a plurality of second electrodes provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein the second electrodes comprise membrane electrodes each of which comprises an electrode having a voltage applied thereto, a membrane having means for extracting neutralizer that is attracted to the electrode from the aqueous solution, the system further comprising one or more potential detecting devices positioned near one or more respective second electrodes for sensing the potential of the membranes of the second electrodes, a computing means for computing the voltage drop across the membranes of the one or more respective second electrodes depending upon information derived from the one or more potential detecting devices and the voltage that is applied to the electrodes, and a display device for displaying the computed voltage drop across the membranes of the one or more respective second electrodes.

7. The electrodeposition coating system of claim 6, further comprising a switching device for switchably providing information derived from the potential detecting devices to the computing means.

8. The electrodeposition coating system of claim 5, further comprising means for generating a signal if the voltage drop across one of the membranes computed by the computing means is greater than a reference value.

9. An electrodeposition coating system comprising a first electrode suspended in an electrodeposition bath as an article to be coated, a second electrode provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein the second electrode comprises a membrane electrode comprising an electrode having a voltage applied thereto and a current provided thereto from a voltage source, a membrane having means for extracting neutralizer that is attracted to the electrode from the aqueous solution, the membrane having an inner side facing towards the first electrode and an outer side facing away from the first electrode, the system further comprising a current detecting device for detecting the current provided to the electrode, a potential detecting device positioned on the outer side of the membrane for detecting the potential on the outer side of the membrane, a first computing means for computing the electrical resistance of the membrane based on a current signal provided by the current detection device and a voltage signal provided by the potential detecting device, a second computing means for computing the voltage drop across the membrane based on a voltage signal provided by the potential detecting device and the voltage that is applied to the electrode, a third computing means for computing the electrical resistance of the membrane based on a current signal provided by the current detecting device and a voltage signal provided by the potential detecting device and the voltage that is applied to the electrode, and a display device for displaying results of the computations performed by the first, second and third computing means.

10. An electrodeposition coating system comprising a first electrode suspended in an electrodeposition bath as an article to be coated, a plurality of second electrodes provided in association with the first electrode, and a source of current connected between the first electrode and the second electrode wherein the current is adapted to pass through an aqueous solution of a substance contained in the electrodeposition bath to electrodeposit the substance for forming a coated film onto the first electrode, wherein each of the second electrodes comprises a membrane electrode comprising an electrode having a voltage applied thereto, a membrane having means for extracting neutralizer that is attracted to the electrode from the aqueous solution, the membrane having an inner side facing towards the first electrode and an outer side facing away from the first electrode, wherein for each membrane of one or more of the electrodes is provided with a current detecting device for detecting current flow to the electrode, and a potential detecting device for detecting the voltage on the outer side of the membrane of membrane electrode, the system further comprising a first computing means for computing the electrical resistance for at least one of the membranes based on a current signal provided by the current detecting device for the at least one of the membranes and a voltage signal provided by the potential detecting device for the at least one of the membranes, a second completing means for computing the voltage drop across at least one of the membranes based on a voltage signal provided by the potential detecting device for the at least one of the membranes and the voltage that is applied to the electrodes, a third computing means for computing the electrical resistance of at least one of the membranes based on a current signal provided by the current detecting device for at least one of the membranes and a voltage signal provided by the potential detecting device for at least one of the membranes and the voltage that is applied to the electrodes, and a display device for displaying results of the computations performed by the first, second and third computing means.

11. The system of claim 10, further comprising a first switching device for switchably providing information derived from the current detecting devices to one or more of the computing means, and a second switching device for switchably providing information derived from the potential detecting devices to one or more of the computing means.

12. An electrodeposition painting device comprising a first electrode arranged in an electrodeposition bath and adapted to hang a painted subject, and a second electrode corresponding to the painted subject, wherein the electrodeposition painting device is adapted to electrodeposit on the painted subject a film forming material by means of electrical conduction through an aqueous solution of the film forming material provided in the electrodeposition bath in between the painted subject and the second electrode, wherein the second electrode comprises multiple membrane electrode devices, the membrane electrode devices each comprising an electrode having a voltage applied thereto, a membrane having an exterior part and having means for extracting neutralizer that is attracted to the electrode, wherein, in each membrane electrode device is provided an electrical current detection device and an electrical potential detection device that detects the potential of the exterior part of the membrane, a computing means for computing the electrical resistance of the membrane based on a current value detected by the electrical current detection device and the voltage applied to the electrode, the computing means also computing the voltage drop across the membrane based on an electrical potential value detected by the electrical potential detection device and the voltage applied to the electrode, the computing means also computing the electrical resistance of the membrane based on a current value detected by the electrical current detection device and the voltage applied to the electrode and an electrical potential value detected by the electrical potential detection device, the system further comprising an operation mode setting device that sets the operating mode of the computer means, and a data display for displaying the computation results of the computing means.

13. An electrodeposition painting device comprising a first electrode arranged in an electrodeposition bath and adapted to hang a painted subject, and a second electrode corresponding to the painted subject, wherein the electrodeposition painting device is adapted to electrodeposit on the painted subject a film forming material by means of electrical conduction through an aqueous solution of the film forming material provided in the electrodeposition bath in between the painted subject and the second electrode, the second electrode comprising a plurality of membrane electrode devices, the membrane electrode devices each comprising an electrode having a voltage applied thereto, a membrane having an exterior part and having means for extracting neutralizer that is attracted to the electrode, for one or more of the plurality of membrane electrode devices, an electrical current detection device and an electrical potential detection device for detecting the potential of the exterior part of the membrane for the membrane electrode device, a computing means for computing the electrical resistance of the membrane based on a current value detected by the electrical current detection device and the voltage applied to the electrode, the computing means also computing the voltage drop across the membrane based on an electrical potential value detected by the electrical potential detection device and the voltage applied to the electrode, the computing means also computing the electrical resistance of the membrane based on a current value detected by the electrical current detection device and the voltage applied to the electrode and an electrical potential value detected by the electrical potential detection device, the system further comprising an operation mode setting device that sets the operating mode of the computer means, and a data display for displaying the computation results of the computing means.

14. The electrodeposition painting device of claim 5, wherein the potential detection device comprises a sensor electrode that is arranged opposite to the outerside of the membrane, tubular support material made from an insulating material fitted on one end of the sensor electrode, high resistance material fitted in the tubular support material and connected in series with the sensor electrode, and a signal line connected in series with the high resistance materials for transmitting electrical potential information detected by the sensor electrode through the high resistance material to a sensor output terminal on the other end of the tubular support material.

15. A method of electrodeposition painting, comprising the steps of:

positioning an article to be painted as a first electrode in an electrodeposition paint bath;

inducing electrical flow between the first electrode and a second electrode and through a membrane positioned in the electrodeposition paint bath between the first and second electrodes to electrodeposit a paint on the article;

determining the electrical potential of the membrane;

determining the current flowing between the first and second electrodes; and calculating the resistance of the membrane.

16. The method of claim 15, further comprising the steps of:

comparing the resistance of the membrane with a reference value: and generating a signal indicative of the resistance of the membrane equalling or exceeding the reference value.

17. A method of electrodeposition painting, comprising the steps of:

positioning an article to be painted as a first electrode in an electrodeposition paint bath;

inducing electrical current flow between the first electrode and a second electrode and through a membrane having a resistance condition positioned in the electrodeposition paint bath between the first and second electrodes, the resistance condition of the membrane varying over time; and electrically determining the resistance condition of the membrane.

18. The method of claim 17, wherein the electrical current flow is induced by applying a voltage between the first and second electrodes, and wherein the step of electrically determining the resistance condition of the membrane comprises the steps of:

determining the current flowing between the first and second electrodes;

determining the voltage applied between the first and second electrodes; and calculating the resistance of the membrane.

19. The method of claim 17, wherein the electrical current flow is induced by applying a voltage between the first and second electrodes, and wherein the step of electrically determining the resistance condition of the membrane comprises the steps of:

determining the potential of the membrane; and determining the current flowing between the first and second electrodes.

20. The method of claim 17, further comprising the steps of:

determining a reference value of the resistance condition of the membrane, the reference value corresponding to a degradation level of the electrodeposition painting, the degradation level corresponding to the resistance condition of the membrane; and determining whether the resistance condition of the membrane is greater than the reference value.

* * * * *